US007668472B2

(12) United States Patent
Kella et al.

(10) Patent No.: US 7,668,472 B2
(45) Date of Patent: Feb. 23, 2010

(54) METHODS FOR MODERATING VARIATIONS IN WRITING PARAMETERS IN LIQUID TONER PRINTING

(75) Inventors: Dror Kella, Nes-Ziona (IL); Amiran Lavon, Bat Yam (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 483 days.

(21) Appl. No.: 11/261,285

(22) Filed: Oct. 28, 2005

(65) Prior Publication Data

US 2007/0098425 A1 May 3, 2007

(51) Int. Cl.
*G03G 15/10* (2006.01)

(52) U.S. Cl. ..... 399/57

(58) Field of Classification Search ..... 399/55, 399/57, 58, 61, 62
See application file for complete search history.

(56) References Cited

U.S. PATENT DOCUMENTS 4,860,924 A * 8/1989 Simms et al. ..... 399/57
5,319,421 A * 6/1994 West ..... 399/59
5,369,476 A * 11/1994 Bowers et al. ..... 399/49
5,963,758 A * 10/1999 Corn et al. ..... 399/57
5,987,273 A * 11/1999 Yamamoto ..... 399/58
6,151,469 A * 11/2000 Lee ..... 399/237
6,364,544 B1 * 4/2002 Sasayama et al. ..... 396/578
6,600,884 B2 * 7/2003 Shimmura ..... 399/57
2004/0146328 A1 * 7/2004 Sasayama ..... 400/118.2

FOREIGN PATENT DOCUMENTS

EP 425144 A2 * 5/1991

* cited by examiner

*Primary Examiner*—Quana M Grainger

(57) ABSTRACT

A method of maintaining at least one writing parameter within a range during printing in a liquid toner printing system, comprising: setting an acceptable range for the at least one writing parameter; and, determining if the at least one writing parameter is within the range; wherein if the at least one writing parameter is not within the range, the method further comprises calculating a target conductivity for liquid toner used in the printer, corresponding to a value within the writing parameter range and moving the liquid toner conductivity towards the target conductivity.

10 Claims, 5 Drawing Sheets

METHODS FOR MODERATING VARIATIONS IN WRITING PARAMETERS IN LIQUID TONER PRINTING

FIELD OF THE INVENTION

The present application is concerned with the control of imaging parameters in electrostatographic printing.

BACKGROUND OF THE INVENTION

Liquid electrostatic printing suffers from the inherent nature of the toner changing its properties during the course of usage. For example, the conductivity and/or charging of the toner changes while being used to make prints. Techniques in common usage today correct writing head parameters, such as laser power, developer voltage (the charging on the developer), photoreceptor charging and possibly the look up tables and screen sets to compensate for changes in the toner and thusly in order to keep the final output (e.g. the prints) constant. In general a desired value of charging of the toner is set a priori and the other parameters are varied to provide an optimum or at least an acceptable image. Then the charging of the toner is controlled to preserve image quality. Control of the charge director component of the toner in response to a conductivity measurement is sometimes used to modify toner charging, such as described in U.S. Pat. No. 4,860,924 to Simms, et al., the disclosure of which is incorporated herein by reference. A low field conductivity measurement, which is a measure of a current between electrodes immersed in the toner reservoir, is often used.

During operation the conductivity of the toner is monitored. The system is purposely unbalanced so that the charge level falls slowly with use. Charge director is added to increase the charge on the toner particles, when the measured conductivity reaches a lower threshold level. From time to time, a calibration step is carried out, to adjust the developer voltage and laser power to optimize image quality for the particular batch and condition of the toner. Using a system in which the target value of toner low field conductivity is set, the developer voltage and laser power is allowed to vary during the periodic calibrations. It is noted that between calibrations the voltage and laser power remain constant and only the conductivity value is controlled.

These corrective measures come with their own problems such as increased background development due to high developer voltage, inhomogeneous solid print due to low developer voltage, varied developed spot shape due to highly variable developer voltage, expensive lasers must be used due to the demands of highly variable power requirements, and/or hard-to-gauge correlation between measured area cover versus digital input cover which leads to unstable color and linework, just to name a few. In general these variations will only take place from time to time.

An additional problem is that, while this system does give good image quality, there are slight variations in the color balance of images between different printers and between different batches of toner in the same printer, as well as slight variations with time.

SUMMARY OF THE INVENTION

As indicated above the prior art sought to control the charge per unit mass of the toner (Q/M) and thus the calibration of the printer using low field conductivity measurements of the toner. This was based on the proposition that the amount of toner deposited on the photoreceptor depends on the amount of charge deposited. Thus, controlling the charge based on a predetermined target low field conductivity value should give consistent imaging results between printers and between batches of toner.

A two step procedure was followed. When calibrating the printer, the low field conductivity was controlled to a relatively high accuracy (with respect to a predetermined target conductivity) and the developer voltage and laser power adjusted to give good images. Between calibrations (i.e., during operation), as the charge on the toner decreased, charge director was added to keep the toner conductivity near the target value. The developer voltage and laser power were not adjusted between calibrations.

The present inventors have discovered that one of the problems with the previous control method is that the measurements of low field conductivity that are traditionally used to control the charge per unit mass of the toner (Q/M) do not always accurately represent the actual Q/M. Furthermore, batch to batch variations may subtly change the coloration of images. Furthermore, they have discovered that lower variability in image quality and characteristics is provided when an optimal developer voltage (rather than optimal toner conductivity) is used as the basis for image quality control. Thus, in general, the control methods of the present invention result in lower variability from printer to printer as well as lower variability from toner batch to batch in a same printer.

In an exemplary embodiment of the invention, during calibration writing parameters such as developer voltage and optionally laser power are kept relatively constant at predetermined optimum (target) values while the toner charge, based on the measured low filed conductivity value, is allowed to vary over a wider range than heretofore.

Generally, during operation (i.e., between calibrations), the charge in the toner is maintained by keeping the toner's low field conductivity at some target value as in the prior art. However, this target value is not a constant, but may be adjusted at each calibration (or even between calibrations) in order to achieve the target wring parameters (e.g., developer voltage and optionally laser power). Thus, during calibration, the target toner low field conductivity value is adjusted so that one or more of the writing parameters, for example the developer voltage, is kept relatively close to an optimal value.

In modifying the target conductivity value of the toner in order to prevent widely varying the writing parameters, a substantial portion of the problems created by the prior art solutions is avoided. Furthermore, in an exemplary embodiment of the invention, maintenance of writing parameters within certain narrow ranges provides increased uniformity of print quality over several printers as compared with the prior art.

In an exemplary embodiment of the invention, toner is initially provided with a nominal level of conductivity. Optionally, the amount of any material (e.g., charge director) which affects the toner conductivity is modified to vary overall toner conductivity. For example, charge director content is increased or decreased based on calibration printing results in order to achieve a developer voltage which provides an optimal or near optimal quality of printing. Optionally, increasing of charge director content includes adding charge director component to the toner. Optionally, decreasing of charge director content includes exhausting toner, for example through printing, until charge director content is decreased to a desired level.

In an embodiment of the invention, a first calibration is performed using toner in the printer. This calibration results in particular levels of developer voltage and laser power for best imaging. The developer voltage is compared with an optimum target value. If the value is different, then the target point for the conductivity of the toner is changed from the present target point, optionally incrementally, in a direction that will result in a reduction in the difference between the developer voltage achieved in the next calibration and the optimum value. The new target low filed conductivity value is used between calibrations in the same way as described above with respect to the prior art.

Considering the lack of desirability of making large changes in the parameters (developer voltage, laser power and low field conductivity of the toner) between calibrations, a number of methods are available for reaching the optimum developer voltage in stages. In general, these methods produce a small change in the target toner low field conductivity value with each calibration. As the developer voltage approaches the optimum value during a calibration, a decision is made to either incrementally change the low field conductivity target value or not, depending on how far the developer voltage (determined during that calibration) is from the optimum value. Optionally, a measure of toner conductivity different from low field conductivity is used. Optionally, a different method of calculating the amount of charge director present in the toner is used. Optionally, developer voltage is not the writing parameter used as a goal for non-variance.

In an exemplary embodiment of the invention, incremental, fixed steps towards a target low field conductivity are made by modifying the charge director component when developer voltage is determined to be out of a predetermined range. Optionally, at least one limit is set on the target low field conductivity such that it can't be set too high and/or too low. Optionally, varying degrees of incremental, fixed steps are made depending on the difference between the target low field conductivity and the measured low field conductivity. For example, where the measured low field conductivity is different from the target low field conductivity by a high percentage, a larger amount of charge director component is added for correction towards the target. Alternatively a fixed change is used. In an exemplary embodiment of the invention, target low field conductivity is that low field conductivity which is likely to produce desired printed results and/or developer voltage. As described herein, optionally the target low field conductivity is an intermediate step to another target low field conductivity which is likely to produce desired printed results and/or developer voltage.

In an exemplary embodiment of the invention, the target low field conductivity is modified depending on an estimate of the change of low field conductivity needed to reach the optimum developer voltage. The estimated required change in target low field conductivity is calculated using a measured developer voltage, a measured low field conductivity, the target developer voltage and a function correlating changes in developer voltage determined during calibration with changes low field conductivity. Optionally, a function correlating developer voltage with low field conductivity is a gradient number which is defined as a ratio between the change of the developer voltage determined during calibration caused by a change in low field.

Optionally, the degree to which target low field conductivity is modified depends on how great the difference between the estimated developer voltage and the target developer voltage. For example, where the estimated developer voltage is different from the target developer voltage by a predetermined level, a larger modification to target low field conductivity is performed. Optionally, the modification to the target low field conductivity is limited at a particular calibration. Optionally, gradual modification to the target low field conductivity is performed by limiting the number of printings between calibrations.

There is thus provided, in accordance with an embodiment of the invention, a method of maintaining at least one writing parameter within a range during printing in a liquid toner printing system, comprising:

setting an acceptable range for said at least one writing parameter; and, determining if said at least one writing parameter is within said range, wherein if said at least one writing parameter is not within said range, the method further comprises calculating a target conductivity for liquid toner used in said printer, corresponding to a value within said writing parameter range and moving a liquid toner conductivity towards said target conductivity.

Optionally, the conductivity is a low field conductivity of the toner. Optionally, moving low field conductivity includes adding charge director to a toner used in said printing to increase said low field conductivity. Optionally, moving the low field conductivity includes printing to reduce said low field conductivity.

Optionally, the at least one writing parameter is developer voltage. Optionally, the developer voltage is within ±10% or ±5 of a predetermined target value.

In an embodiment of the invention, the method comprises:

determining the proximity of a measured writing parameter to said target writing parameter;

wherein if said measured writing parameter is not within said acceptable range, setting said target conductivity parameter to a present target conductivity parameter plus a fixed, incremental value so as to move said writing parameter into said range.

Optionally, at least one limit is placed on the value of said new target writing parameter.

Optionally, a plurality of expanding ranges are set, each with a corresponding increased increment.

In a embodiment of the invention, the method comprises:

estimating a target writing parameter at a present target conductivity; and, determining if said estimated target writing parameter is within said acceptable range, wherein if said estimated target writing parameter is not within said acceptable range, modifying said target conductivity.

Optionally, a plurality of expanding ranges are set for said target conductivity, each with a corresponding increased modifying value to said target low field conductivity. Optionally, modifying said target low field conductivity occurs in a plurality of stages.

Optionally, the method further comprises:

periodically measuring a conductivity associated with said at least one writing parameter;

calculating a target value for said at least one writing parameter using said periodic measurements; and, calculating a target conductivity associated with said target writing parameter value based on said target writing parameter.

Optionally, at least one limit is placed on said target value of said at least one writing parameter.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. In the attached figures.

DESCRIPTION OF EXEMPLARY EMBODIMENTS

As described herein, the toner used in conjunction with liquid electrostatic printing has properties which vary as it is used in the printing process. An exemplary varying property of the toner includes its charging. This variable charging effects assorted other aspects of the printing process since the process utilizes electrostatic forces in order to lay down a predetermined amount of toner in various positions. Typical solutions for the variable chargeability of the toner include modifying the developer voltage and/or the laser writing head power during calibration of the printer, for example as described in U.S. Pat. No. 4,860,924. These solutions have inherent problems, such as those described in the Background and summary sections. Furthermore, measurements of changes in the toner, as they are performed today, are susceptible to error and/or error propagation, which lead to non-optimal modification of the developer voltage and/or laser power in response to those measurements.

Some embodiments of the invention seek to avoid substantial modification of developer voltage and/or laser power by determining a set point value for the toner conductivity and tracking and adjusting the charge director component of the toner to keep the developer voltage optimal. This is contrasted with the prior art, in which it was believed that the toner conductivity should be kept at an optimal level. Currently (in the prior art), developer voltage can change from −250V to −650V and the target conductivity is measured on the order of 100 pmho/cm. In accordance with an exemplary embodiment of the invention, the developer voltage operates in a range of ±30V from 425V. Optionally, the range is ±50V from 425V. Optionally, the range is larger than ±50V from 425V.

Figure 1:
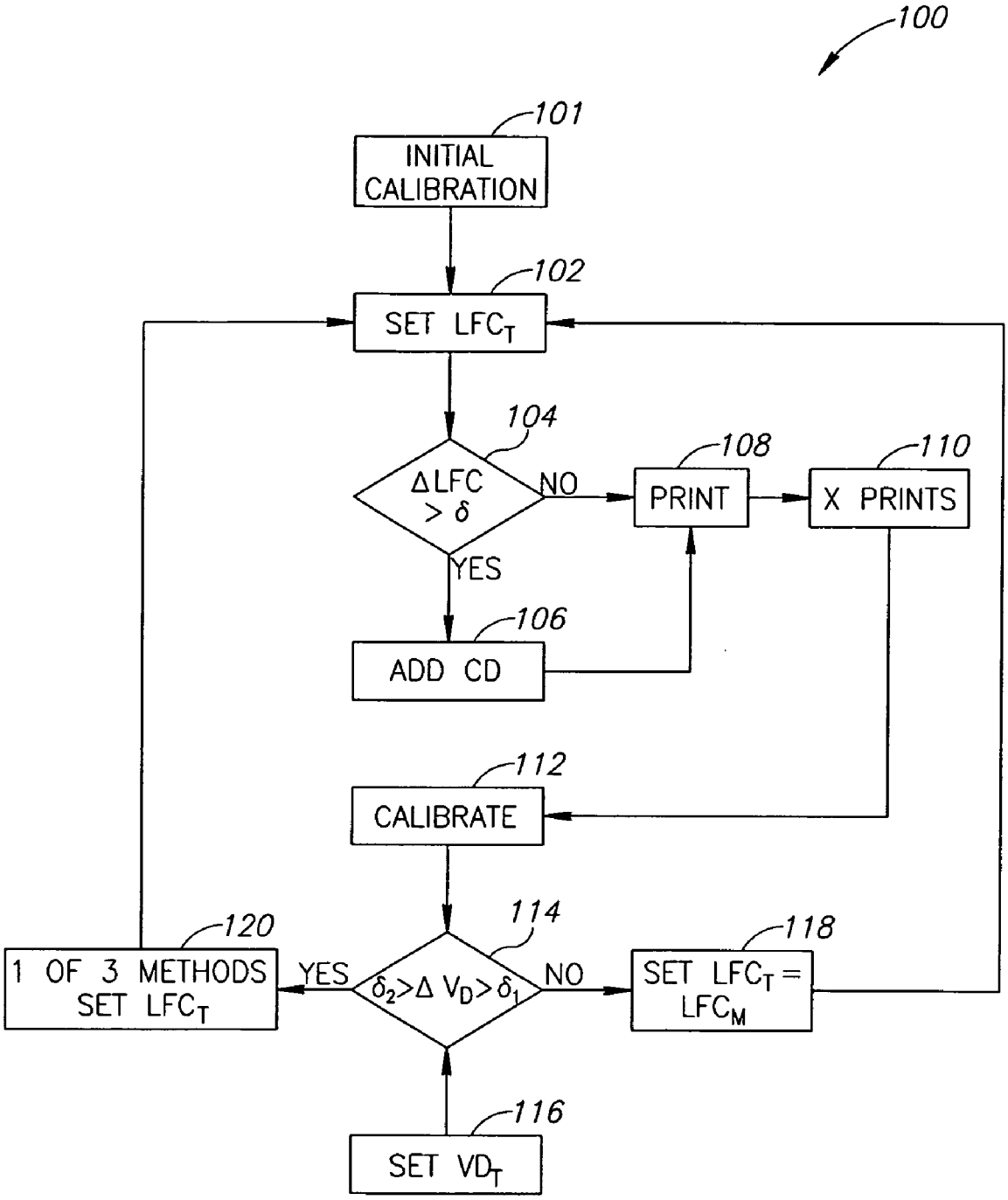
FIG. 1 is a generic flowchart depicting a method for maintaining writing parameters at or near optimum values for printing including the prior art solution used in conjunction with the methods described herein, in accordance with an exemplary embodiment of the invention.

Referring to FIG. 1, a generic flowchart 100 is shown which depicts a method for maintaining writing parameters at or near optimum values for printing, in accordance with an exemplary embodiment of the invention. Since parts of this method are similar to that used in the prior art, we will first describe, in the following three paragraphs, the prior art calibration/control method An initial calibration 101 is generally performed, for example when a toner cartridge is placed in the printer, or when a predefined number of prints have been performed. Generally, for the initial calibration, the target low field conductivity is set (102) based on pre-determined values of observed effective low field conductivity for producing quality prints and the writing parameters (e.g., laser power and developer voltage) are determined to give good images.

In some exemplary embodiments of the invention, the low field conductivity is measured by electrodes placed within the toner reservoir. If it is determined (104) after measurement that the low field conductivity is within an acceptable range, the printing process is started (108) in accordance with the nominal operation of the printer. However, if it is determined (104) that the low field conductivity is below an acceptable range, then a charge director component is added (106) to the toner in order to bring the low field conductivity of the toner into the acceptable range. Once the low field conductivity is judged to be within an acceptable range, printing is started (108). It should be noted that low field conductivity measurement methods are not the only methods of measuring the conductivity of the toner, and thus indirectly the amount of charge director present in the toner. Any method for measuring toner conductivity could optionally be employed.

After printing a predetermined number of prints (110), the printer is typically recalibrated (112) to reset various writing parameters to optimal or near optimal numbers for printing. Calibration (112) is typically performed in order to compensate for the varying nature of the toner, for example. In the prior art, calibration often involves modifying writing parameters, such as developer voltage and laser power, within a relatively (compared to the present invention) wide range of values. This cycle (102)-(112) is the traditional method of attempting to produce quality prints over the course of use of a batch of toner and is similar to the method described in U.S. Pat. No. 4,860,924 to Simms, et al.

In an exemplary embodiment of the invention, improvements to the standard method of regulating writing parameters are added to the cycle (102)-(112) in order to further enhance print quality and/or save costs. Improvements include keeping writing parameters at or near an optimal value for quality printing. The developer voltage is calculated during calibration (112), as in the prior art. If it is determined (114) that the developer voltage is within an acceptable range in relation to a target developer voltage, determined (116) previously, the measured low field conductivity is set (118) as the target low field. If, however, it is determined (114) that the developer voltage is outside a first acceptable range in relation to a target developer voltage, the target low field conductivity must be reset (120) in order to bring the developer voltage within acceptable limits. As described below with respect to FIGS. 2-4, there are at least three methods for setting the target low field conductivity in order to acquire an acceptable developer voltage, in accordance with exemplary embodiments of the invention.

It should be noted that in each case, even if the developer voltage is outside the first acceptable range but inside a second range in which acceptable print quality is achieved, printing continues and changes in the target low field conductivity are made using one of the three methods described below.

Figure 2:
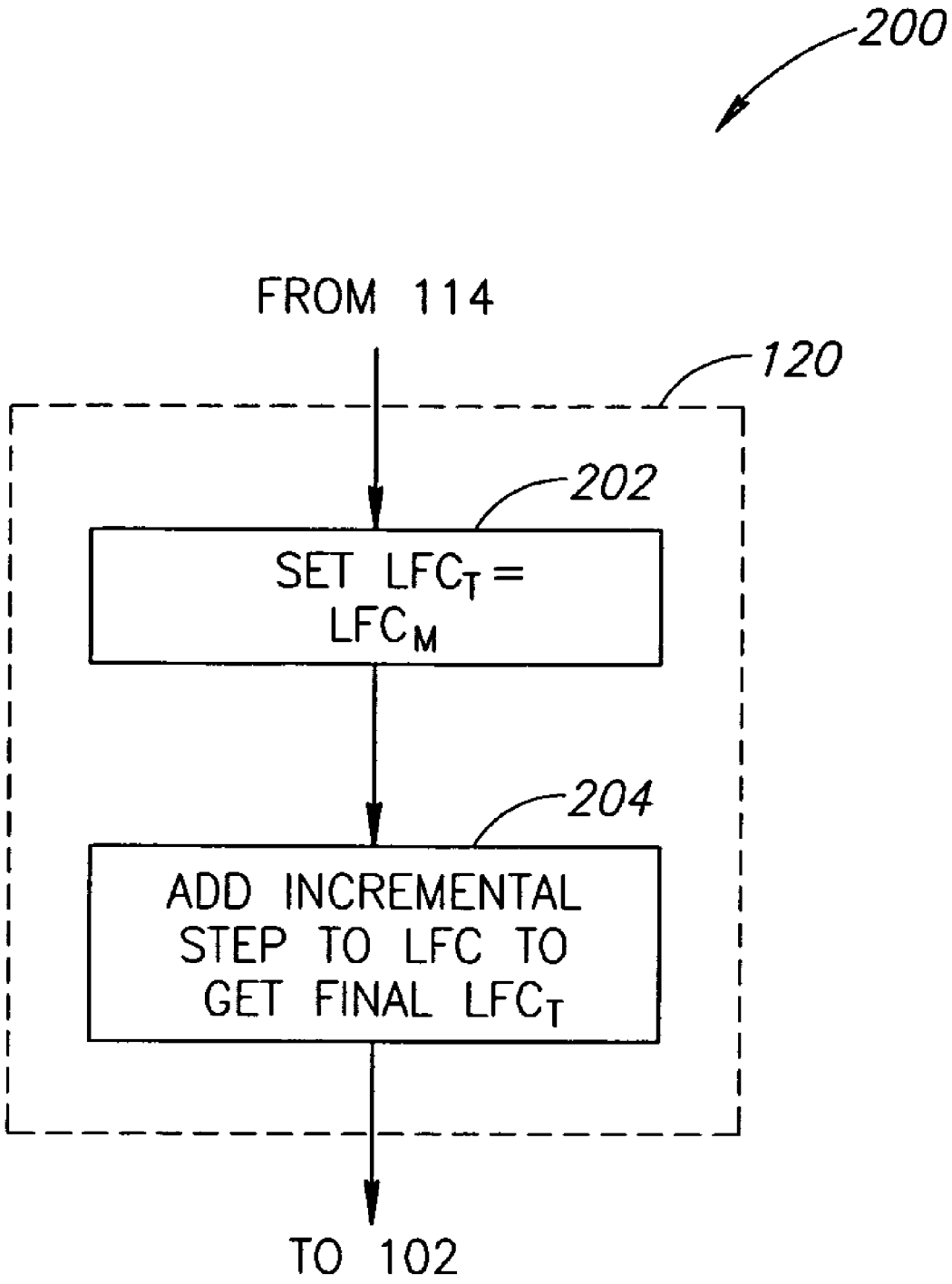
FIG. 2 is a flowchart depicting a method for maintaining a range of developer voltage while using incremental, fixed amounts of charge director component to modify low field conductivity, in accordance with an exemplary embodiment of the invention.

Referring to FIG. 2, a first method 200 of setting a target low field conductivity is described, in accordance with an exemplary embodiment of the invention. As described previously, a determination (114) is made regarding the measured developer voltage's proximity to a target developer voltage. If it is determined (114) that the measured developer voltage is not within an acceptable range of the target developer voltage, method 200 sets (202) the target low field conductivity to a new value equal to the measured low field conductivity associated with the measured developer voltage modified by a fixed increment depending on whether the determined developer voltage is above or below the optimum. Thus, an incremental, fixed amount is added or subtracted (204) from a new target low field conductivity which would bring the developer voltage towards the target developer voltage if a new calibration were to be made with the toner at its new target. The new target low field conductivity including the incremental correction is now the target low field conductivity used at (102) between calibrations. Optionally, high and/or low limits to target low field conductivity are imposed. These limits are optionally instituted in order to avoid adverse effects on components of the printer caused by extremely high or extremely low low-field conductivity.

Alternatively to using a single fixed step in conductivity for adjustment, varying degrees of incremental, fixed steps are made depending on the difference between the target low field conductivity and the measured low field conductivity. For example, where the measured low field conductivity is different from the target low field conductivity by more than a pre-set percentage, a larger change in set point for low field conductivity is used for correction towards the target.

In an exemplary embodiment of the invention, the increment is selected to be small enough so that the new set point remains well within the range of acceptable values for the old set point, during operation. This avoids the production of unacceptable prints between calibrations.

Some specific examples of method 200 are presented in accordance with an exemplary embodiment of the invention. Assume that target low field conductivity is 90 picomho/cm, target developer voltage is 425V, and the acceptable range is 30V on either side of the target developer voltage. Furthermore, assume that the last calibration resulted in a developer voltage of 450V. In this example, no changes are made because 450V is still within the acceptable range of 395V-455V.

However, assume the last adjustment in developer voltage resulted in 460V, which is outside the predefined acceptable range. Assume further that the maximum deviation during operation from the set point is +7 to −6 picomho/cm. This variation results as the toner is discharged during operation and then recharged by addition of charge director. Assume further that the incremental change in set point is allowed to be +8 or −7 picomho/cm.

For the first example assume also that the measured low field conductivity which corresponds to the calibration value of 460V is 93 picomho/cm. In this example, the target low field conductivity is set to (93−7)=86 picomho/cm. As toner is consumed during printing, the low field conductivity will decrease, and when charge director is added, will oscillate between 79 and 94 picomho/cm. Assuming a gradient of 2V/picomho/cm, the next calibration with low field conductivity between 79 and 94 picomho/cm will produce a developer voltage to between 442 and 462 volts, for the extreme values of low field conductivity. Any value above 450V will induce a further reduction in target low field conductivity and thus a confinement of developer voltage. It is noted that since the present low field conductivity is within the new range, there will be no charge director added to the toner, until the charge is reduced during operation.

In another example the value of developer voltage is 390V and the measured low field conductivity is 85, all the rest of the parameters are the same. In this case the target low field conductivity becomes 85+8=93 picomho/cm after adding the incremental step. The new range for low field conductivity is now 86 to 101 picomho/cm. Since the value is out of range by 1 picomho/cm there will be an immediate addition of a dose of charge director.

As should be understood, the measured low field conductivity is not necessarily the present target value. In the following method, during calibration, the developer voltage for good prints is determined. This acts as the basis for determining what would have been the optimal voltage were the low field value actually at the target.

Figure 3:
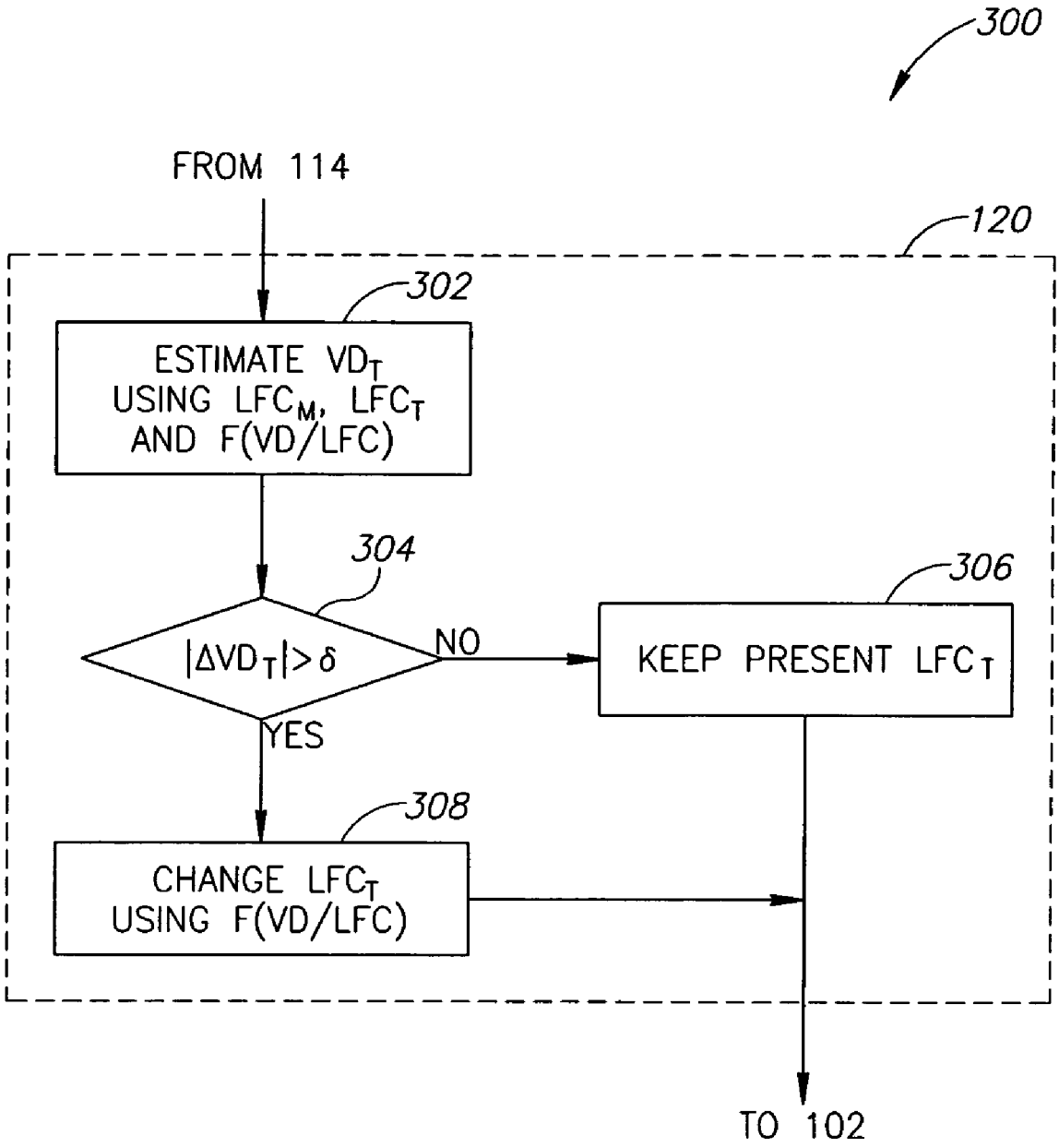
FIG. 3 is a flowchart depicting a method for approximating developer voltage at a target low field conductivity and making adjustments, in accordance with an exemplary embodiment of the invention.

Referring to FIG. 3, a second method 300 of setting a target low field conductivity is shown in accordance with an exemplary embodiment of the invention. This method 300 computes an adjusted developer voltage (302) corresponding to the present target low field conductivity. This adjusted developer value (denoted as $VD_T$ in box 302 of FIG. 3) is determined by using the actual developer voltage determined in the calibration, the target low field conductivity and the measured low field conductivity as inputs and then using and the rate of change of developer voltage with change in low field conductivity to adjust the developer voltage.

A determination (304) is made wherein if the adjusted (302) developer voltage is within an acceptable range, then the target low field conductivity is unchanged (306. If however, it is determined (304) that the target developer voltage is outside of an acceptable range, the target low field conductivity is modified (308), optionally using the function correlating developer voltage and low field conductivity, to a number which provides an acceptable target developer voltage. The target low field conductivity is used in lieu of the set (102) target low field conductivity. Optionally, the degree to which target low field conductivity is modified depends on how great the difference between the estimated developer voltage and the target developer voltage. For example, where the estimated developer voltage is different from the target developer voltage by a predetermined level, a larger modification to target low field conductivity is performed. Optionally, the modification to the target low field conductivity is performed in a gradual manner. Optionally, gradual modification to the target low field conductivity is performed by limiting the modification based on the number of printings.

A specific example of method 300 is presented in accordance with an exemplary embodiment of the invention. Assume that measured developer voltage is 449V, target low field conductivity is 90 picomho/cm, measured low field conductivity is 95 picomho/cm, target developer voltage is 425V and the function is 2V/pmho/cm. The estimated developer voltage calculation (at the present set point) results in 439V, which is 14V higher than the target developer voltage. Therefore, the target low field conductivity is adjusted to 83 picomho/cm, using the 2V/picomho/cm ratio. It is noted that this new target low field conductivity is lower than the measured low field conductivity of 95 pmhocm. The lower target is achieved by exhausting the conductivity of the toner through printing. Optionally, an automatic mechanism replaces part of the toner in order to reduce the conductivity.

In a different example, wherein degrees of difference are treated differently, assume that the present target low field conductivity is 100 picomho/cm and the measured low field conductivity is 109 picomho/cm. A first degree of difference from developer voltage is defined as 30V and a corrective increment of 14 picomho/cm is used for voltages greater than this degree of difference (as opposed to 0 for lesser). Assume further that target developer voltage is 425V, the measured developer voltage is 460V and the function is 2V/picomho/cm. Calculating an estimated developer voltage using the target low field conductivity provides a result of 442V. Because this voltage is not outside the 30V degree of difference from the target developer voltage, no change is made to the target low field conductivity. However, assuming the same numbers, but with a measured low field conductivity of 94, the calculation of the estimated developer voltage using the target low field conductivity provides a result of 472V. This is greater than the 30V degree of difference from the target developer voltage of 425V. Therefore, the target low field conductivity will be adjusted down up by 14 picomho/cm to 86 picomho/cm.

It should be noted that in the first and second methods, the developer voltage is not changed until the next calibration. Only the set point for toner low field conductivity is reset.

Figure 4:
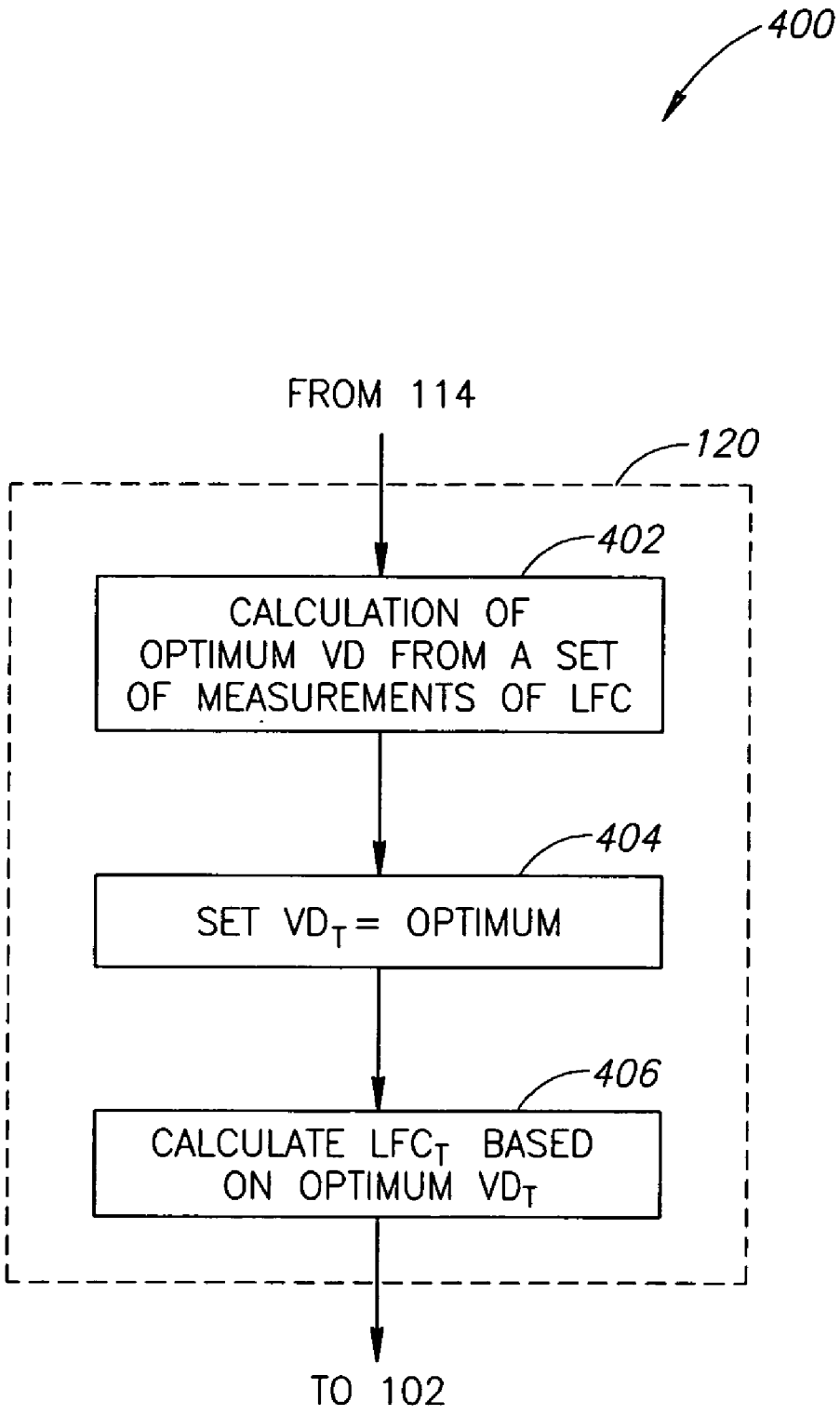
FIG. 4 is a flowchart depicting a method for using periodic evaluations of performance at certain developer voltages and making adjustments for optimized performance, in accordance with an exemplary embodiment of the invention.

Referring to FIG. 4, a third method 400 of setting a target low field conductivity is shown in accordance with an exemplary embodiment of the invention. In method 400, periodic evaluations of performance are conducted at certain developer voltages and adjustments to determine a relationship between target low field conductivity and resulting developer voltage for optimized performance, in accordance with an exemplary embodiment of the invention. If the measured developer voltage is determined (114) to be outside the optimum range of a target developer voltage, a corresponding target low field conductivity is optionally calculated (402) based on the predetermined relationship and the present values of developer voltage and low field conductivity. This optimum developer voltage is set (404) as the developer voltage. From this developer voltage and the relationship between developer voltage and low field conductivity, a target low field conductivity is calculated (406). The calculated (406) target low field conductivity is used as the set (102) target low field conductivity. Optionally, an incremental step towards the target developer voltage is taken by setting a target low field conductivity which is only an incremental step towards the low field conductivity which corresponds to the optimal developer voltage. Optionally, upper and/or lower limits are set on the change in developer voltage.

A specific example of method 400 is presented in accordance with an exemplary embodiment of the invention. Assume the function correlating developer voltage with low field conductivity is 2V/picomho/cm, the target developer voltage is 425V, the measured developer voltage is 380V and the measured low field conductivity is 71 picomho/cm. The target low field conductivity is calculated to be 93 picomho/cm. Therefore, charge director is added to raise the conductivity and the developer voltage is raised to the developer voltage is changed to match the target. Since the charge director is added in predetermined amounts it may not be possible to reach the exact value of charge that is desired. In this case, the voltage is adjusted to match the charge level achieved. Where the charge has to be reduced to reach optimal developer voltage, the printer is operated to reduce the charge level and the developer voltage (and set point) are reduced in increments.

Figure 5:
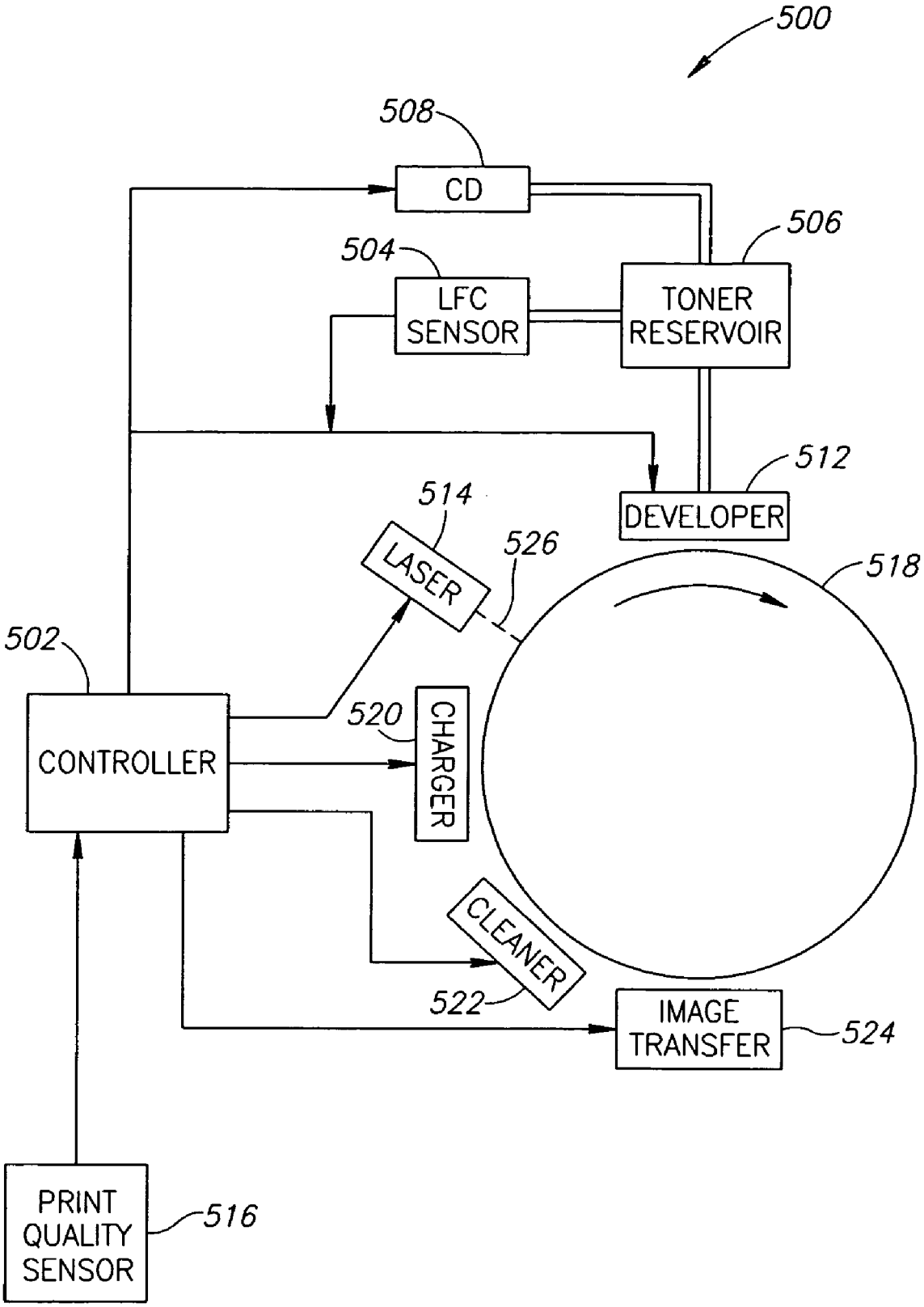
FIG. 5 is a schematic block diagram of a printing apparatus in accordance with an embodiment of the invention.

Referring to FIG. 5, a schematic diagram is shown demonstrating the relationship of a plurality of elements of a printing apparatus 500, in accordance with an exemplary embodiment of the invention. The printing apparatus 500 shown in FIG. 5 is purely schematic to illustrate that the invention can be performed on any liquid toner printer or copier. It is contemplated that the invention will be applied to the HP Indigo series II family of digital printers and can be applied to sheet-fed or web-fed printing apparatuses. It can be applied to systems which transfer toner to a final substrate either one color separation as well as to printing apparatuses which transfer all the separations to an intermediate transfer member and then transfer the group of separations to the final substrate together. Furthermore, the exact mode of development is not important to the practice of the invention, and development can be by binary (layerwise) transfer of high concentration toner or by electrophoretic development using any of the multitude of methods known for bringing the toner into contact with a latent image.

Printing apparatus 500 optionally comprises conventional components such as a photoreceptor imaging cylinder 518, having a photoreceptor attached or bonded to it and an axis about which the cylinder rotates, and an image transfer section 524 for transferring the developed image to a substrate either directly or via an intermediate transfer member. A charger 520, a laser unit 514 that provides a scanning laser beam 526 for generating latent images on photoreceptor 518, a developer 512 for developing the latent images and optionally, a cleaning station 522 are positioned around the perimeter of photoreceptor 518.

A printing apparatus provided with the elements described with respect to FIG. 5 is capable of carrying out the methods described herein. A controller 502 is provided in the printing apparatus in order to issue commands to printing apparatus elements, receive data from printing apparatus elements, process printing apparatus element data, and/or to control printing apparatus operation, in an exemplary embodiment of the invention. Optionally, printing apparatus elements include writing parameter controlling elements, such as a developer 512 and/or a laser 514. Optionally, printing apparatus elements include sensors, such as a low field conductivity sensor 504, a developer voltage sensor 510 and/or a print quality sensor 516. Optionally, printing apparatus elements include reservoir tanks for storing printing materials, such as a toner reservoir 506 and/or a charge director reservoir 508.

In an exemplary embodiment of the invention, low field conductivity measurements described in the context of the methods above are made by low field conductivity sensor 504. In an exemplary embodiment of the invention, developer voltage measurements described in the context of the methods above are optionally made by a developer voltage sensor and supplied to controller 502. In an exemplary embodiment of the invention, print quality measurements described in the context of the methods above are made by print quality sensor 516. In some exemplary embodiments of the invention, the low field conductivity measured in toner reservoir 506 is modified (increased) by adding charge director from charge director reservoir 508. Optionally, the low field conductivity measured in toner reservoir 506 is modified (reduced) by printing. In some exemplary embodiments of the invention, controller 502 receives data from at least one of the sensors 504 or 516 and processes the received data in order to determine what, if any, modifications will be made to developer 512, laser 514 and/or toner reservoir 506. Optionally, a modification includes changing developer 512 voltage. Optionally, a modification includes changing laser 514 power. Optionally, a modification includes altering the low field conductivity of toner reservoir 506.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A method of maintaining at least one writing parameter within a range during printing in a liquid toner printing system, comprising:

setting an acceptable range for said at least one writing parameter; and, determining if said at least one writing parameter is within said acceptable range, wherein if said at least one writing parameter is not within said acceptable range, the method further comprises calculating a target conductivity, corresponding to a value within said acceptable range, for toner used in said printing system, and moving a conductivity of said toner towards said target conductivity, wherein said conductivity is a low field conductivity of said toner, wherein said low field conductivity is increased by adding charge director to said toner and reduced by printing, and wherein said at least one writing parameter is developer voltage.

2. A method according to claim 1 wherein said developer voltage is within ±10% of a predetermined target value.

3. A method according to claim 1 wherein said developer voltage is within ±7% of a predetermined target value.

4. A method of maintaining at least one writing parameter within a range during printing in a liquid toner printing system, comprising:

setting an acceptable range for said at least one writing parameter; and, determining if said at least one writing parameter is within said acceptable range, wherein if said at least one writing parameter is not within said acceptable range, the method further comprises calculating a target conductivity, corresponding to a value within said acceptable range, for toner used in said printing system, and moving a conductivity of said toner towards said target conductivity, wherein said conductivity is a low field conductivity of said toner, and wherein said moving said conductivity includes printing to reduce said low field conductivity, determining a proximity of a measured value of said writing parameter to a target value of said writing parameter;

wherein if said measured value of said writing parameter is not within said acceptable range, setting said target conductivity to a present conductivity plus a fixed, incremental value so as to move said writing parameter into said acceptable range, wherein a plurality of expanding ranges are set, each with a corresponding increased increment.

5. A method according to claim 4, wherein moving said conductivity includes adding charge director to said toner to increase said low field conductivity.

6. A method according to claim 4, wherein at least one limit is placed on the value of said target conductivity.

7. A computer program product encoded with software to run on a processor and adapted to implement the method of claim 4.

8. A printer arranged to implement the method of claim 4.

9. A method of maintaining at least one writing parameter within a range during printing in a liquid toner printing system, comprising:

setting an acceptable range for said at least one writing parameter; and, determining if said at least one writing parameter is within said acceptable range, wherein if said at least one writing parameter is not within said acceptable range, the method further comprises calculating a target conductivity, corresponding to a value within said acceptable range, for toner used in said printing system, and moving a conductivity of said toner towards said target conductivity, wherein said conductivity is a low field conductivity of said toner, and wherein said moving said conductivity includes printing to reduce said low field conductivity, estimating a target writing parameter at a present target conductivity; and determining if said estimated target writing parameter is within said acceptable range, wherein if said estimated target writing parameter is not within said acceptable range, modifying said target conductivity, wherein a plurality of expanding ranges are set for said target conductivity, each with a corresponding increased modifying value to said target conductivity.

10. A method according to claim 9, wherein modifying said target conductivity occurs in a plurality of stages.

* * * * *